United States Patent [19]

Shores et al.

[11] Patent Number: 4,734,661

[45] Date of Patent: Mar. 29, 1988

[54] COAX TO SLAB LINE CONNECTOR AND PROGRAMMABLE ATTENUATOR USING THE SAME

[75] Inventors: David H. Shores, Beaverton; John R. Snook, Portland, both of Oreg.

[73] Assignee: Tektronix, Inc., Beaverton, Oreg.

[21] Appl. No.: 937,660

[22] Filed: Dec. 4, 1986

[51] Int. Cl.[4] ..... H01P 1/04; H01P 1/22

[52] U.S. Cl. ..... 333/33; 333/81 A; 333/260

[58] Field of Search ..... 333/33, 34, 81 A, 260

[56] References Cited

U.S. PATENT DOCUMENTS

| | | | |
|---|---|---|---|
| 2,913,686 | 11/1959 | Fubini et al. | 333/238 |
| 3,319,194 | 5/1967 | Adam | 333/260 X |
| 3,325,752 | 6/1967 | Barker | 333/260 X |
| 3,686,624 | 8/1972 | Napoli et al. | 333/260 X |
| 3,705,379 | 12/1972 | Bogar | 333/260 X |
| 4,346,355 | 8/1982 | Tsukii | 333/260 X |

*Primary Examiner*—Paul Gensler
*Attorney, Agent, or Firm*—Francis I. Gray

[57] ABSTRACT

A programmable microwave attenuator includes coax to slab line connectors which use rigid pin inner conductor captivation at an inner conductor interface surface within the confines of the coaxial outer conductor to improve mechanical reliability and reduce frequency dependent insertion losses. Narrow gaps between the edges of the slab line inner conductor and the coaxial outer conductor reduce unwanted modes of microwave energy transmission by concentrating the electric field at the edges of the slab line inner conductor before it emerges from the coaxial outer conductor into the slab line. A similar gap exists between the edges of the slab line inner conductor and the slab line outer conductor so that unwanted modes of microwave energy transfer are minimized after the outer conductor interface surface.

11 Claims, 8 Drawing Figures

COAX TO SLAB LINE CONNECTOR AND PROGRAMMABLE ATTENUATOR USING THE SAME

BACKGROUND OF THE INVENTION

The present invention relates to connectors used between coaxial signal lines and microwave frequency slab lines, and more particularly to a coax to slab line connector with improved inner conductor captivation and reduced insertion loss variation. The present invention further relates to programmable microwave attenuators using such coax to slab line connectors.

Conventional coax to slab line connectors are modified standard female coax connectors in which the folded over end of a slab line inner conductor is pressed into a slot cut into the termination end of the cylindrical coax inner conductor to form a spring contact. This conventional arrangement results in a mechanically unreliable connection in which the slab line inner conductor is disturbed whenever an external mating connector is connected or disconnected.

At sufficiently high microwave frequencies, when the wavelength is less than about twice the slab line cavity depth, undesirable, frequency dependent coupling losses occur as a result of unwanted modes of microwave energy transmission. For example, with a typical slab line cavity depth of 0.5 inches (1.28 cm) some energy is lost at frequencies above about 11.8 GigaHertz as a result of multiple reflections in the $TE_{10}$ mode of transmission. The magnitude of this insertion loss is frequency dependent.

Therefore, what is desired is a coax to slab line connector, and a programmable microwave attenuator using such connectors, that provides mechanically reliable connection with insertion losses relatively independent of frequency.

SUMMARY OF THE INVENTION

Accordingly, the present invention provides a mechanically reliable coax to slab line connector in which the inner conductors are captivated to the connector insulation by mechanical force applied by a pin rigidly fixed to the connector housing. Unwanted, frequency dependent insertion losses are minimized by positioning the inner conductor transition interface surface within the confines of the coaxial outer conductor and concentrating the electric field in the narrow gap between the edges of the slab line inner conductor and the coaxial outer conductor. This concentration of the electric field minimizes unwanted modes of microwave energy transmission within the confines of the slab line outer conductor after the outer conductor transition interface.

The objects, advantages and other novel features of the present invention will be apparent from the following detailed description when read in conjunction with the appended claims and attached drawings.

DETAILED DESCRIPTION OF THE PREFERRED EMBODIMENT

Figure 1:
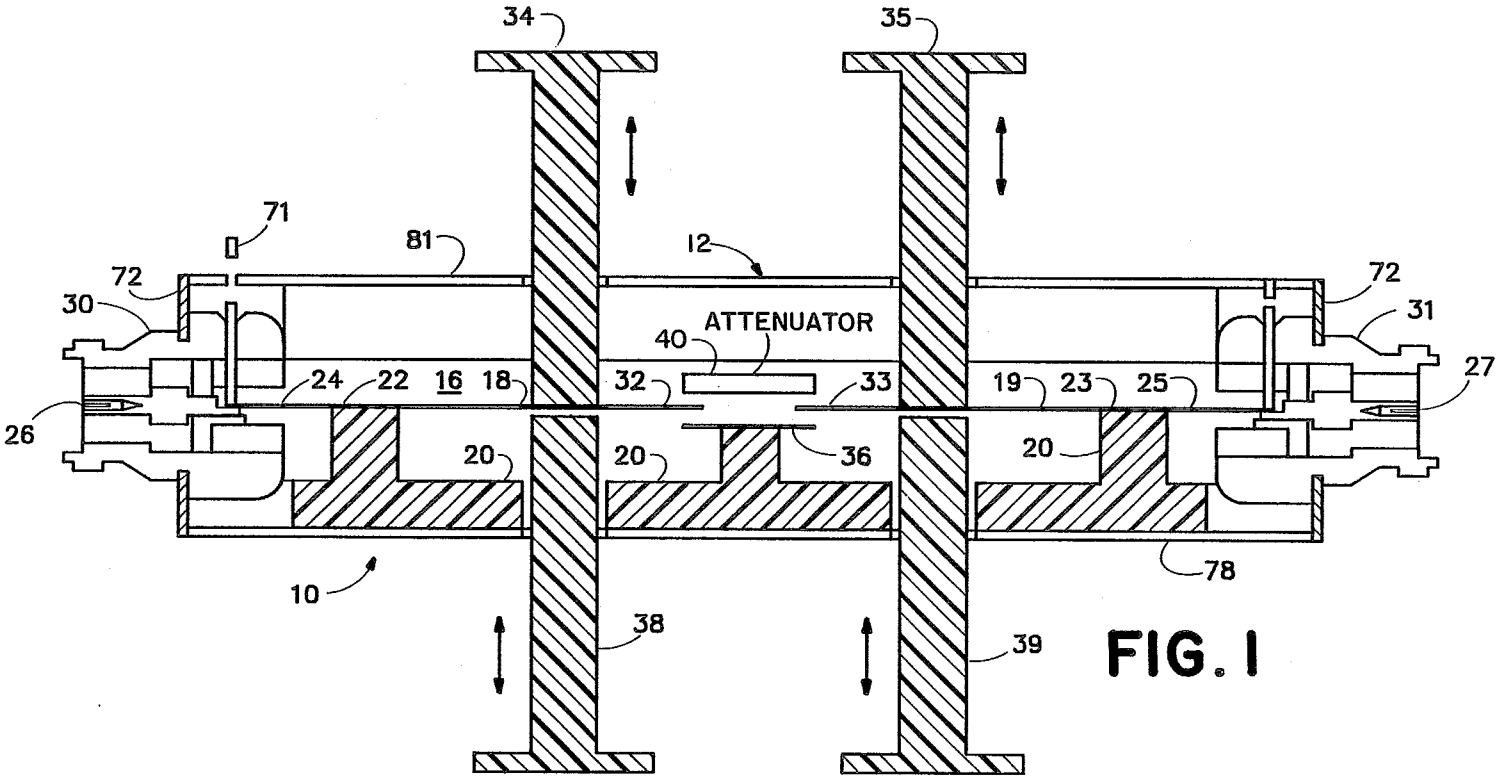
FIG. 1 is a cross-sectional view of a programmable attenuator including a coax to slab line connector according to the present invention.

Referring now to FIG. 1, programmable slab line attenuator 10, shown in cross-sectional view, includes rectangular aluminum housing 12 composed of housing main channel 78, a pair of attenuator housing caps 72 and housing cover 81 surrounding a central cavity 16.

Within cavity 16, slab line inner conductor portions 18 and 19 are mounted on insulating member 20 at attachment points 22 and 23. Connector end 24 of slab line inner conductor 18 is connected to inner conductor 26 of slab line connector 30, which is mounted in attenuator housing cap 72 as described below in greater detail with reference to FIG. 3. Similarly, connector end 25 of slab line inner conductor 19 is connected to inner conductor 27 of coax to slab line connector 31, which is identical to connector 30.

Contact end 32 of slab line inner conductor 18 may be actuated by push pin 34 to contact fixed conductor 36 or by push pin 38 to contact attenuator chip 40. Similarly, contact end 33 of slab line inner conductor 19 may be actuated by push pin 35 to contact fixed conductor 36 or by push pin 39 to contact attenuator chip 40. Fixed conductor 36 is attached to insulating member 20, as shown. Attenuator chip 40 is mounted to rectangular aluminum housing 12 in any convenient manner, not shown.

In this manner it can be seen that activation of push pins 34 and 35, mounted in housing cover 81, interconnect slab line inner conductors 18 and 19 via conductor 36 to form a continuous slab line between connectors 30 and 31. Similarly, activation of push pins 38 and 39, mounted in housing main channel 78, interconnect slab line inner conductors 18 and 19 via attenuator chip 40 to form an attenuated slab line. Various values of attenuation can be programmably inserted into this signal path with the proper combinations of attenuation chips and push pin actuations.

Figure 3:
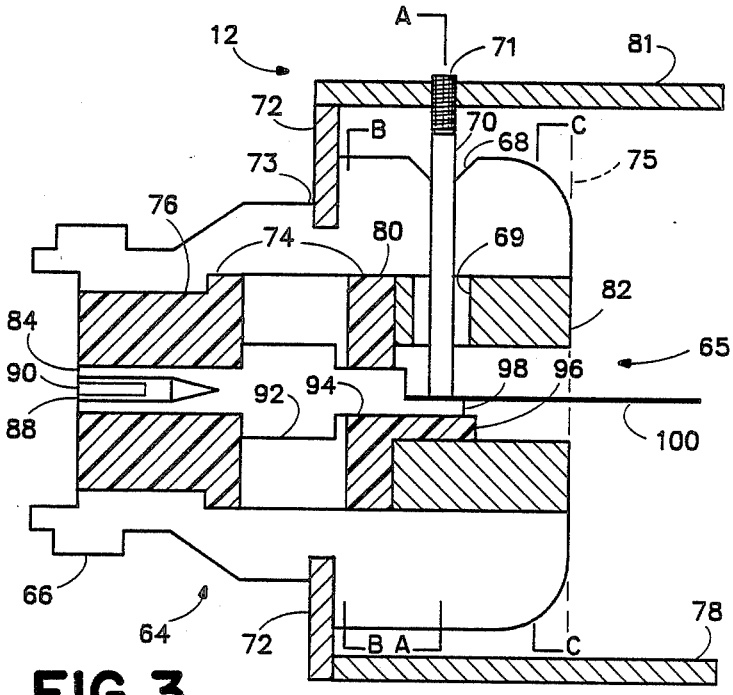
FIG. 3 is a cross-sectional view of a coax to slab line connector according to the present invention and used in the programmable attenuator of FIG. 1.

The coax to slab line inner conductor interface, as can be seen in more detail with reference to line A—A of FIG. 3, occurs within the confines of the coaxial outer conductor formed by the housing of connector 30, which itself is within the confines of the slab line outer conductor formed by rectangular aluminum housing 12. This position of the inner conductor interface surface, and the resultant concentration of the electric field at the edges of the slab line inner conductor, reduces unwanted modes of microwave energy transmission as described below with reference to FIGS. 6, 7 and 8. This greatly reduces frequency dependent insertion losses.

Figure 2:
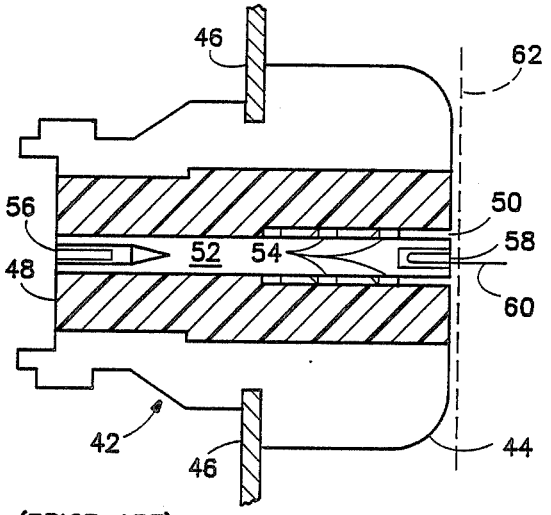
(PRIOR ART) FIG. 2
FIG. 2 is a cross-sectional view of a coax to slab line connector according to the prior art.

Referring now to FIG. 2, conventional coaxial connector 42, modified in accordance with prior art practice for use in prior art programmable attenuators, includes cylindrical connector housing 44 which serves as the outer conductor of the coaxial signal line as well as the mechanical connection for connector 42 between both attentuator housing 46 and the mating conventional male coaxial connector, not shown.

Insulating member 48 is mounted securely within connector 42 and includes cavity 50 into which is pressed inner conductor 52 held securely therein by barbs 54 or similar means. Inner coaxial conductor 52 includes mating coaxial connector cavity 56 at the end thereof positioned outside of the programmable attenuator, and slab line connector cavity 58 at the end positioned within the programmable attenuator. Connector 42 may conveniently have been manufactured by modifying a standard coaxial connector by cutting a slot in inner conductor 52 to add slab line connector cavity 58.

Prior art slab line inner conductor 60 may be made by forming a fold in the end thereof so that after insertion of the folded end within slab line connector cavity 58, it is held in place by spring force. This results in a mechanically unreliable connection because forces applied by the mating coaxial male connector, not shown, to cavity 56 to connect or disconnect the signal line are transmitted directly to and disturb prior art slab line inner conductor 60 held in place solely by spring tension.

In addition, the physical transitions between coaxial and slab inner conductors, as well as coaxial and slab outer conductors, both occur at interface surface 62. This abrupt transition results in unwanted, frequency sensitive, multimode microwave energy transmission and therefore frequency sensitive insertion losses. Within the coaxial transmission path, the electric field is uniformly distributed. Within the slab line, the preferred mode of energy transmission results from the electric field being concentrated between the edges of the inner conductor and the walls of the outer conductor.

The simultaneous transition of inner and outer conductors results in unwanted modes of energy transmission because the electric field is uniformly distributed within the coaxial outer conductor and is available, at the transition interface, at locations other than the gap between the edges of the inner conductor and the walls of the slab line outer conductor.

These problems can be alleviated in accordance with the present invention by providing a secure mechanical transition between the coaxial and slab inner conductors at an interface surface within the coaxial outer conductor in a manner which concentrates the electric field at the edges of the slab line inner conductor so that the tendency to transmit microwave energy in unwanted modes is reduced.

Referring now to FIG. 3, coax to slab line connector 64 in accordance with the present invention, includes cylindrical connector housing 66 substantially identical in construction to housing 44, discussed above with reference to FIG. 2, except that connector housing 66 includes a threaded opening 68 in which a plastic rod 70 is secured by a set screw 71 to make the inner conductor captivation in a mechanically secure manner.

Connector housing 66 serves as the outer conductor of the coaxial signal line and is secured in an opening in attenuator housing cap 72 so that groove 73 retains the edge of housing cap 72. Attenuator housing cap 72, together with housing main channel 78 and housing cover 81, make up rectangular aluminum housing 12 which serves as the outer conductor of the slab line signal path. In this manner it can be seen that the portion of connector 64 between groove 73 and transition surface 75 extends within the confines of the slat line outer conductor, i.e. programmable attenuator housing 12.

Transition surface 75 is the interface at which slab line inner conductor 100 emerges from the shielding of cylindrical connector 66 to be within the shielding of attenuator housing 12. The relationship of slab line inner conductor 100 and attenuator housing 12 is described below in greater detail with regard to FIG. 5.

Insulating member 74 is formed from two separate pieces; collar 76 and retainer 80. Collar 76 is mounted securely within central cavity 65 and includes cavity 84 into which is pressed one end of coaxial inner conductor 88. Inner conductor 88 includes mating coaxial connector cavity 90 at the end thereof positioned outside of the programmable attenuator.

Coaxial inner conductor 88 includes retaining shoulder 92 which is retained by a lip 94 of retainer 80, holding coaxial inner conductor securely within connector housing 66. Retainer 80 is then inserted over coaxial inner conductor 88 so that semi-circular contact surface 98 of coaxial inner conductor 88 extends through a central opening therethrough and is supported by an anvil 96, a semi-cylindrical extension of retainer 80.

Ring 82, preferably constructed from electrically conducting material such as aluminum, is then inserted in the remaining cavity of connector housing 66 so that it forms a support for anvil 96 of retainer 80 and captivates the pieces of insulating member 74 and inner conductor 88 securely in place. Non-conductive plastic rod 70 may then be inserted through opening 68 of housing 66 and passageway 69 of electrically conducting ring 82.

Set screw 71 is mounted in housing cover 81 of attenuator housing 12 to secure plastic rod 70. Plastic rod 70 serves as a rigid pin to captivate slab line inner conductor 100 against semi-circular contact surface 98 thereby providing mechanically secure and reliable inner conductor captivation and a transition surface within the confines of coaxial outer conductor housing 66.

Line A—A represents the inner conductor interface surface. As can clearly be seen in FIG. 3, this inner conductor interface is positioned within the coaxial outer conductor formed by housing 66.

Figure 4:
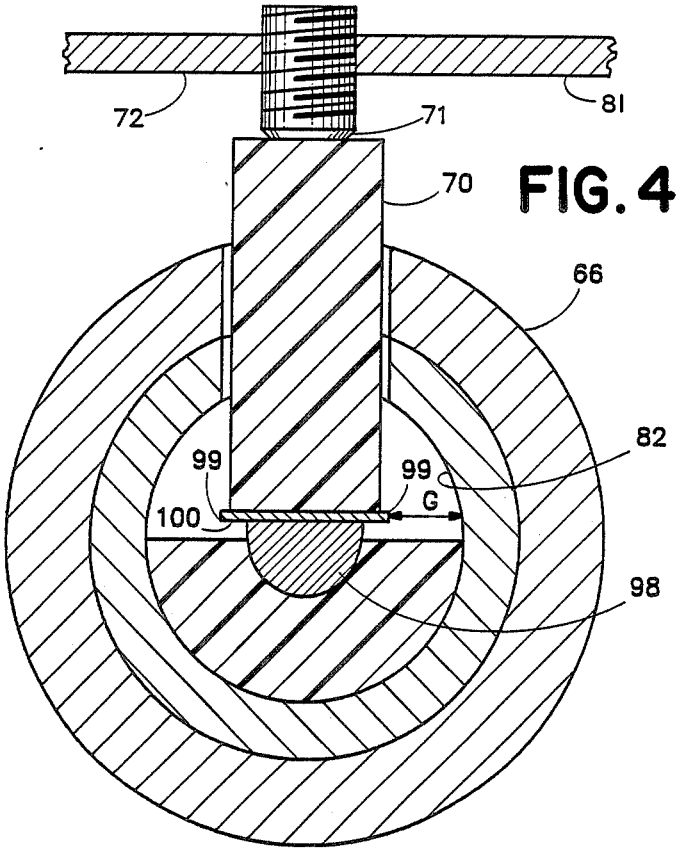
FIG. 4 is a cross-sectional view of the inner conductor captivation interface of the coax to slab line connector of FIG. 3 taken along the line A—A.

Referring now to FIG. 4, the mechanical security of the captivation may be seen clearly in this magnified, cross-sectional view of the inner conductor captivation interface of coax to slab line connector 64 of FIG. 3 taken along line A—A.

Set screw 71 is mounted in housing cover 81 of attenuator housing 12 and may be tightened down against plastic rod 70 which presses slab line inner conductor 100 against semi-circular contact surface 98 which is supported on anvil 96, in turn supported by ring 82 which is pressed against connector housing 66. Slab line inner conductor 100 has a rectangular cross-section in which the width is substantially greater than the thickness. A narrow gap, identified as dimension G, is formed between each edge 99 of slab line inner conductor 100 and the ring 82 in contact with the cylindrical connector housing 66. These narrow gaps serve to concentrate the electric field at the edges of the slab line inner conductor and thereby reduce unwanted modes of energy transmission within the slab line conductor as described below with reference to FIGS. 7 and 8.

Figure 5:
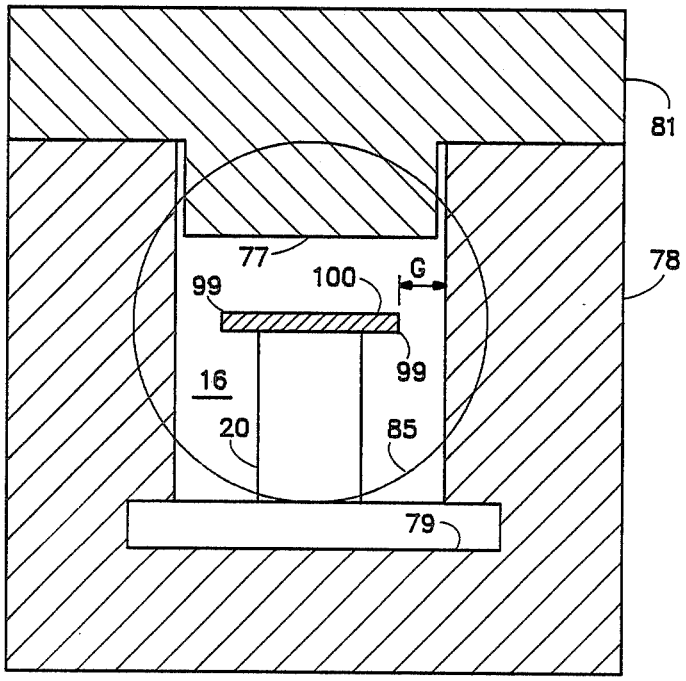
FIG. 5 is a cross-sectional end view of the slab line inner and outer conductors of FIG. 3 taken along transition surface 75.

Referring now to FIG. 5, the relationship between the inner and outer conductors of the slab line may clearly be seen in this magnified, cross-sectional view of transition surface 75, looking away from coax to slab line connector 64, as shown in FIG. 5.

Attenuator housing 12 is shown in cross-sectional view so that its relationship with slab line inner conductor 100 is apparent. Edges 99 of slab line inner conductor 100 are separated from housing main channel 78 by a pair of narrow gaps indicated by the dimension G. The width of these gaps is preferably of the same order of magnitude as the gaps between edges 99 and the ring 82 in contact with the cylindrical connector housing 66 as shown in FIG. 4.

Slab line inner conductor 100 is mounted on insulating member 20 which may conveniently have a widened portion or base that fits within an appropriate opening 79 in housing main channel 78 of attenuator housing 12. Housing cover 81 of attenuator housing 12 may conveniently include lip 77 which extends within central cavity 16 to prevent unwanted modes of energy transmission in accordance with practices well known in the art.

Housing main channel 78 and housing cover 81 press against ring 82 to hold ring 82 within coax to slab line connector 64. Outline circle 85 has been drawn on FIG. 5 to illustrate the relationship between ring 82 and the various parts of rectangular aluminum housing 12 at transition surface 75.

Figure 6:
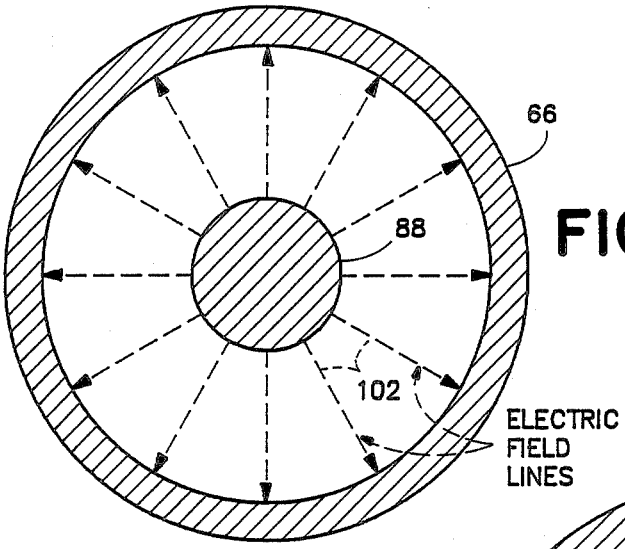
FIG. 6 is a schematic representation of a cross-sectional end view of the coaxial transmission path showing the electric field lines between the inner and outer coaxial conductors of the connector of FIG. 3 taken along the line B—B.

Referring now to FIG. 6, electric field lines 102 are uniformly distributed between coaxial inner conductor 88 and cylindrical connector housing 66 of coax to slab line connector 64 of FIG. 3 when viewed at the cross-section indicated by line B—B. This is the same uniform distribution pattern which occurs in the electric field of the electromagnetic wave propagating along the coaxial transmission line, not shown.

Figure 7:
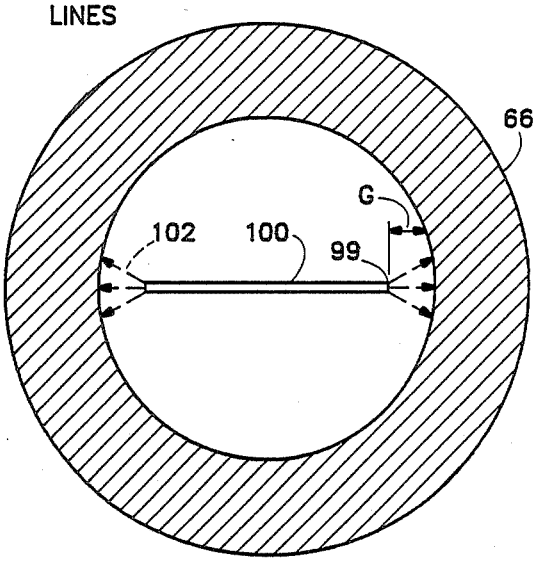
FIG. 7 is a schematic representation of a cross-sectional end view showing the electric field lines between the inner slab line and the outer coaxial conductors of the connector of FIG. 3 taken along the line C—C.

Referring now to FIG. 7, electric field lines 102 in the transition area between the coaxial and slab lines are concentrated in the narrow gap, indicated by the dimension G, between edges 99 of slab line inner conductor 100 and the coaxial outer conductor formed by the ring 82 in contact with the cylindrical connector housing 66. In a typical configuration, the outer conductor diameter would be on the order of 0.110 inches (0.28 cm) and the inner conductor would be on the order of 0.070 inches (0.18 cm) wide leaving a pair of narrow gaps on the order of about 0.02 inches (0.05 cm) wide.

These narrow gaps prohibit unwanted modes of microwave energy transfer until the frequency exceeds approximately 53 GigaHertz. The transition to a pure slab line may then be made without causing the unwanted modes of transition by preserving the narrow gap between the inner and outer conductors. The gap between edges 99 and the slab line outer conductor is maintained after the transition as seen in FIG. 8.

Figure 8:
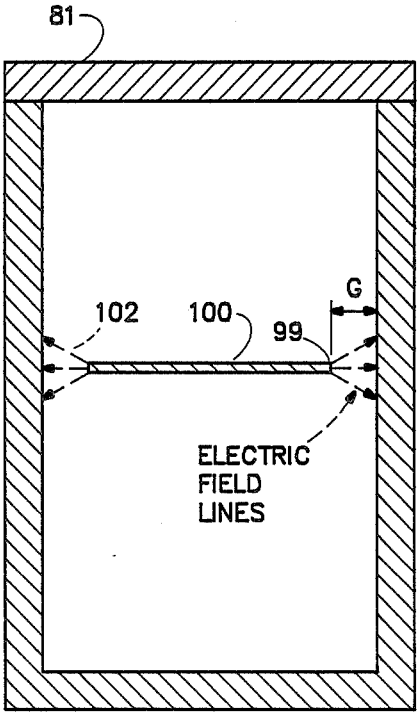
FIG. 8 is a schematic representation of a cross-sectional end view showing the electric field lines between the inner and outer slab line conductors of the connector of FIG. 3 taken along transition surface 75.

Referring now to FIG. 8, electric field lines 102 within the slab line beyond transition surface 75 remain concentrated in the narrow gaps between edges 99 of slab line inner conductor 100 and the slab line outer conductor formed by housing main channel 78 and housing cover 81. In a typical configuration, the largest dimension of the slab line outer conductor could be on the order of 0.5 inches (1.28 cm) as noted above which would permit unwanted modes of microwave energy transmission above 11.8 GigaHertz. However, the previous concentrating of electric field lines 102 in the narrow gaps at edges 99 of slab line inner conductor 100 greatly limits the amount of energy transmitted in unwanted modes.

Thus, the present invention provides a mechanically secure and reliable coax to slab line connector having its inner conductor interface surface within the confines of the coaxial outer conductor to reduce frequency sensitive insertion losses resulting from unwanted modes of microwave energy transmission.

What is claimed is:

1. A coaxial connector for use with a slab line, comprising:

a coaxial outer conductor including a central cavity;

an insulating member mounted within the coaxial outer conductor;

a coaxial inner conductor supported by the insulating member;

rigid pin means extending into the central cavity for pressing an inner conductor of the slab line against an inner conductor interface surface of the coaxial inner conductor within the confines of the coaxial outer conductor; and an anvil positioned between the coaxial inner and outer conductors to support the inner conductor interface surface, the anvil being a contiguous extension of the insulating member.

2. The connector of claim 1 wherein the coaxial outer conductor comprises means for rigidly mounting the coaxial outer conductor to an outer conductor of the slab line so that a portion of the coaxial outer conductor extends within the confines of the slab line outer conductor.

3. The connector of claim 2 wherein the coaxial inner conductor includes a shoulder and the insulating member comprises:

a collar positioned within the central cavity supporting the coaxial inner conductor; and a retainer positioned within the cavity for pressing the shoulder against the collar to captivate the coaxial inner conductor within the coaxial outer conductor, the anvil being contiguous with the retainer.

4. The connector of claim 3 further comprising an electrically conducting ring, including an opening through which the rigid pin means passes, within the central cavity and in contact with the coaxial outer conductor for supporting the anvil against the pressure applied by the rigid pin means.

5. The connector of claim 1 wherein the edges of the slab line inner conductor are separated from the coaxial outer conductor by a gap sufficiently narrow to reduce unwanted modes of microwave energy transmission.

6. The connector of claim 5 wherein the coaxial outer conductor comprises means for rigidly mounting the coaxial outer conductor to an outer conductor of the slab line so that a portion of the coaxial outer conductor extends within the confines of the slab line outer conductor.

7. The connector of claim 6 wherein the coaxial inner conductor includes a shoulder and the insulating member comprises:

a collar positioned within the central cavity supporting the coaxial inner conductor; and a retainer positioned within the cavity for pressing the shoulder against the collar to captivate the coaxial inner conductor within the coaxial outer conductor, the anvil being contiguous with the retainer.

8. The connector of claim 7 further comprising an electrically conducting ring, including an opening through which the rigid pin means passes, within the central cavity and in contact with the coaxial outer conductor for supporting the anvil against the pressure applied by the rigid pin means.

9. A programmable attenuator comprising:

a slab line outer conductor housing including a central cavity;

a slab line insulating member positioned within the cavity;

a fixed conductor mounted on the insulating member;

an attenuator chip mounted in the cavity opposite the fixed conductor;

a pair of flexible slab line inner conductors, each having a free end and a connector end, mounted to the insulating member in cantilever fashion so that the free ends lie intermediate the fixed conductor and the attenuator chip;

means for pushing the free ends against the fixed conductor in a first position and against the attenuator chip in a second position; and coaxial connector means, having inner conductors and respective outer conductors, extending through the slab line outer conductor for captivating the connector ends against an interface surface of respective inner conductors within the confines of the outer conductors.

10. The programmable attenuator of claim 9 wherein the slab line inner conductors are separated from the coaxial outer conductors by gaps sufficiently small to reduce unwanted modes of microwave energy transmission by concentrating the electrical field.

11. The programmable attenuator of claim 10 wherein the slab line inner conductors are similarly separated from the slab line outer conductor by narrow gaps.

* * * * *